US009102074B2

(12) United States Patent
Dale

(10) Patent No.: US 9,102,074 B2
(45) Date of Patent: Aug. 11, 2015

(54) LOG REST WITH RACK AND PINION SYSTEM

(71) Applicant: Norwood Industries Inc., Kilworthy (CA)

(72) Inventor: Peter Dale, Kilworthy (CA)

(73) Assignee: Norwood Industries Inc., Kilworthy, Ontario (CA)

( * ) Notice: Subject to any disclaimer, the term of this patent is extended or adjusted under 35 U.S.C. 154(b) by 0 days.

(21) Appl. No.: 14/058,812

(22) Filed: Oct. 21, 2013

(65) Prior Publication Data

US 2014/0209212 A1 Jul. 31, 2014

(51) Int. Cl.

| | |
|---|---|
| ***B27B 29/04*** | (2006.01) |
| ***B27B 29/00*** | (2006.01) |
| ***B27B 31/00*** | (2006.01) |
| *B66F 3/10* | (2006.01) |
| *B66F 3/02* | (2006.01) |

(52) U.S. Cl.

CPC ..... *B27B 29/04* (2013.01); *B27B 29/00* (2013.01); *B27B 31/00* (2013.01); *B66F 3/02* (2013.01); *B66F 3/10* (2013.01)

(58) Field of Classification Search

CPC ..... B66F 3/00; B66F 3/02; B66F 3/10; B66F 3/28; B66F 7/025; B66F 7/0608; B66F 7/14; B66F 2700/03

USPC ..... 254/100, 103, 122–124, 2 B

See application file for complete search history.

(56) References Cited

U.S. PATENT DOCUMENTS

| | | | | |
|---|---|---|---|---|
| 3,695,316 | A | 10/1972 | Pluckhahn | |
| 3,926,086 | A | 12/1975 | Crane | |
| 3,934,852 | A * | 1/1976 | Weber et al. | 254/420 |
| 3,965,788 | A | 6/1976 | Granberg | |
| 4,210,049 | A | 7/1980 | Gauthier | |
| 4,235,140 | A | 11/1980 | Reece | |
| 4,245,535 | A | 1/1981 | Lockwood et al. | |
| 4,275,632 | A | 6/1981 | Ross | |
| 4,300,428 | A | 11/1981 | Woodland | |
| 4,307,641 | A | 12/1981 | Shapleigh | |
| 4,640,170 | A | 2/1987 | Bakken | |
| 5,243,892 | A | 9/1993 | Jindra | |
| 5,784,941 | A | 7/1998 | Sanborn | |
| 7,264,226 | B2 * | 9/2007 | Smith et al. | 254/93 R |

(Continued)

FOREIGN PATENT DOCUMENTS

| | | |
|---|---|---|
| CA | 1200180 | 2/1986 |
| CA | 2541734 | 10/2007 |

(Continued)

OTHER PUBLICATIONS

Office Action dated May 21, 2013, for corresponding Canadian Patent Application No. 2,806,456.

Extended European Search Report for EP Application No. 13186477.9, dated May 21, 2014.

*Primary Examiner* — Lee D Wilson

(74) *Attorney, Agent, or Firm* — Calfee, Halter & Griswold LLP

(57) ABSTRACT

A new log support and clamp system (log rest) for a portable sawmill, having a log rest and a log dog. The log rest features a rack and pinion for adjusting a vertical position of the log rest using an actuation mechanism located on the operator's side of the portable sawmill, which improves the ability of the user to affix the log in place for sawing. Also, a portable sawmill having such a log rest.

12 Claims, 4 Drawing Sheets

(56) References Cited

U.S. PATENT DOCUMENTS

| | | | | |
|---|---|---|---|---|
| 7,413,056 | B2 * | 8/2008 | Gonzi et al. | 187/269 |
| 8,327,979 | B2 * | 12/2012 | Lynch et al. | 187/242 |
| 2010/0327241 | A1 * | 12/2010 | Johnsen | 254/85 |
| 2014/0209212 | A1 * | 7/2014 | Dale | 144/250.13 |

FOREIGN PATENT DOCUMENTS

| | | |
|---|---|---|
| CA | 2687623 | 7/2010 |
| FR | 1143911 A | 10/1957 |

* cited by examiner

LOG REST WITH RACK AND PINION SYSTEM

CROSS-REFERENCE TO RELATED APPLICATION

This application claims the benefit of and priority to Canadian Patent Application No. 2,806,456 filed Jan. 24, 2013, under the title LOG REST WITH RACK AND PINION SYSTEM.

The content of the above patent application is hereby expressly incorporated by reference into the detailed description hereof.

FIELD OF THE INVENTION

The present invention relates to a new log support system (log rest) for a portable sawmill. The log rest features a rack and pinion mechanism which improves the ability of the user to raise and lower the log rest from the operator's side of the portable sawmill.

BACKGROUND OF THE INVENTION

There are several prior inventions for portable sawmills.

U.S. Pat. No. 5,784,941 describes a portable sawmill in which the functions of adjusting a cut and making a cut are divided between two separate devices. The invention discloses a vertical chain saw, ideally operated in an upward direction. The patent also discloses a log restraint system comprising a setwork having a headstock and a lockable L-shaped log dog, joined by a clamp which is locked with a lever.

U.S. Pat. No. 5,243,892 discloses a portable sawmill with a frame base and an inverted U-shaped frame, supported by a carriage rolling along side tracks defined by the frame base. In use, the log is placed on the U-shaped frame and clamped with a tubular clamp held within a sleeve and locked in place using threaded blocks.

U.S. Pat. No. 4,640,170 discloses a portable saw mill with a frame that surrounds the log. The frame is dragged or slid along a frame supporting surface. The frame holds a chain saw at the two ends of its blade, in horizontal fashion, with chain saw support members. The invention uses sliding means for facilitating the movement of the frame over the log. The log is secured against rolling using a simple jig or similar means.

U.S. Pat. No. 4,275,632 describes a portable sawmill comprising a U-shaped support or carriage, holding a band saw. When in use, a log is placed between the two guide rails and is supported in place by appropriately distanced log supports.

U.S. Pat. No. 4,307,641 describes a portable sawmill comprising two skid rails, vertical support members, a pair of guide rails. The log is held in place by two externally threaded log screw pins with pointed ends.

U.S. Pat. No. 4,300,428 describes a portable sawmill having a frame, a guide member mounted above the frame, and a carriage. The chain saw is mounted above the log, and operates at about a 45 degree angle to the horizontal. The log is held in place with log dogs which are adapted for hooking the log and holding it in position.

U.S. Pat. No. 4,235,140 describes a saw mill. The logs are held in place with a standard log dog attached to the cross members on which the log is placed.

U.S. Pat. No. 3,965,788 describes a saw guide for use with a vertically operated portable chain saw. The saw guide apparatus is attached directly to the log.

U.S. Pat. No. 3,926,086 describes a portable saw mill that uses a complex pulley system to move the chain saw and supporting platform. When in use, a log is placed, and clamped, between the guide rails, using a set of circular discs eccentrically oriented on a rod.

U.S. Pat. No. 3,695,316 describes a portable timber milling jig that uses a carriage, holding a chain saw, axially surrounding a square guide rail. The chain saw is held at an approximately 45 degree angle and only uses one guide rail, and utilizes ball bearings on the carriage to move the carriage with respect to the guide rail. When in use, a log is placed under the guide rail, and fixed using clamping points driven into the center of the log, to which support clamps are fastened.

Canadian Patent No. 1,200,180 describes a portable saw mill comprising a frame with a guide rail and a carriage moveable along the guide rail. A band saw is supported by the carriage. The carriage is moveable along the guide rail along two sets of wheels, one engaged with the upper side of the guide rail and the other with the lower side. The log is held in place by its own weight, or by stops and a traditional locking dog.

U.S. Pat. No. 4,245,535 describes a portable sawmill with an elaborate hydraulic apparatus for cutting a log. The chain saw cuts in a vertical motion. The log is held in place using a log holding assembly having a toothed prod which grips the outer end of the log, and a cylinder which impales the inner end of the log with a ram, forcing the outer end against the prod.

U.S. Pat. No. 4,210,049 describes an "x" frame for holding a log, with a chain saw affixed to the frame in cantilever position for cutting logs crosswise. The log is held in the nook of the "x" frame.

Canadian patent application 2,541,734 describes a portable sawmill that is easily displaceable, easily assembled and disassembled into portable components, and which can use generic components as its saw and/or guide rails. The log is held in place using traditional log dogs.

Canadian patent application 2,687,623 describes a log support system (log rest) for a portable sawmill. The log rest features a ratcheting, adjustable clamp which allows a user to affix the log in place for sawing. To lower the log rest, a pawl is disengaged from the log, the log rest is manually lowered, and the pawl is re-engaged.

In all cases, the log rest is on the opposite side of the log from the log dog. Accordingly, when the sawmill bed is wide, two operators are required to adjust the log rest and log dog, or the operator must lean over the bed and log (which can inconvenient, if not dangerous), or the operator must walk around the log. Leaning over also strains the back. Walking around is time consuming. As the log rest and log dog must be lowered as the top of the log is removed by cuts, this task must be repeated multiple times.

SUMMARY OF THE INVENTION

The present invention provides a log support and clamp assembly for use in a portable sawmill, comprising a horizontal support beam having two ends for affixing to a sawmill. A log dog having a vertical portion generally perpendicular to said horizontal support beam and extending upwards therefrom, and a top end having a pick protruding therefrom. A log rest assembly having a clamp housing affixed to said support beam and horizontally displaceable thereto, a post connected to or housed within said clamp housing, said post configured in a generally vertical direction and said clamp housing having a rack and pinion mechanism for raising the post relative to the horizontal support beam.

In one embodiment, the rack and pinion mechanism includes a tensioned chain attached to the log rest assembly, and a ratcheted wheel attached to the clamp housing for engaging teeth on the tensioned chain.

In an embodiment, the log support and clamp assembly further includes an actuation mechanism having a second ratcheted wheel attached at one side of the sawmill opposite of the log rest assembly; a rotatable shaft extending between the sides of a sawmill for connecting the ratcheted wheel to the second ratcheted wheel; and a handle attached to the second ratcheted wheel for actuating the ratcheted wheel. Rotation of the handle causes the ratcheted wheel to traverse the chain, thereby raising or lowering the vertical position of the post. For example, the handle may be rotated in a clockwise direction to lower the vertical position of the post and may be rotated in a counterclockwise direction to raise the vertical position of the post.

In an embodiment, the log support and clamp assembly includes a pawl having a tooth for engagement with a notch of the second ratcheted wheel, where the pawl locks the vertical position of the post.

In one embodiment, the log support and clamp assembly can be in an unlocked position, the log dog horizontally displaceable along the horizontal support beam, and in a locked position, the log dog horizontally non-displaceable along the horizontal support beam. In another embodiment, in an unlocked position, the log dog is vertically displaceable relative to the horizontal support beam, and in a locked position, the log dog is vertically non-displaceable relative to the horizontal support beam.

Optionally, the log dog has a log dog handle extending at an upwards angle from the top end. There are many forms of log dogs which can be used in association with the present invention.

The present invention also teaches a portable sawmill comprising the log support and clamp assembly, as well as a kit for retrofitting a log support and clamp assembly to a portable sawmill.

DETAILED DESCRIPTION OF THE PREFERRED EMBODIMENTS

The present invention provides a simple, versatile, cost-effective and portable log support system for a sawmill such as a portable sawmill. The system provides exemplary fixing of the log onto the mill bed, and allows for a user to clamp the log in place utilizing only one hand and from the operator's side of the portable sawmill. This permits the user to use the other hand to stabilize the log until the log rest is moved into the desired position using the rack and pinion mechanism, and the log clamped between the log rest and the log dog, a cam-operated clamp that squeezes the log. The log rest is thus the back-stop against which the log is secured and against which the log dog exerts force, thereby clamping the log. The log rest thus can be quickly raised or lowered to suit the height of the log being milled. The log rest is raised or lowered by turning a handle at the operator's side of the portable sawmill, and the log rest locks in place with a pawl located at the other side of the portable sawmill. The log rest can lock automatically (e.g. by spring activation), or can be manually locked into position. Thus, both the log rest operating mechanism and the log dog are located at the operator's side of the mill bed.

The log rest is particularly suitable for portable sawmills, and for use by mill operators, particularly those working on their own without assistance. It allows for a highly variable log size to be affixed to it, and it allows for a single operator to maneuver the log into place, then clamp the log in place using only one hand to actuate the rack and pinion mechanism by a handle located at the operator's side of the portable sawmill. This allows the user to utilize their other hand to stabilize the log, greatly improving use and safety of a sawmill, for example, when a single person, in a remote area, is sawing logs. The log rest also allows great flexibility in the size of logs being clamped to it, thanks to its highly adjustable nature. Notably, the log rest can be adjusted to a rough log sizing, then fine adjusted for each individual log in an easy, one-handed manner. The operator, using only one hand and staying on the operator's side of the portable sawmill, can raise or lower the log rest to suit the log size by releasing the pawl and turning a handle, actuating the rack and pinion mechanism. The log rest may be locked in place using the pawl located on the operator's side of the portable sawmill.

The log rest design enables it to be sold as part of a sawmill such as a portable saw mill, or as a separate item for retrofitting onto an existing sawmill, for example, as a kit or an accessory option. The log rest can be manufactured from sturdy, reasonably inexpensive materials, and permits a high level of configurability for different size logs.

An embodiment of the present invention will now be described as shown in FIGS. 1-4.

Figure 1:
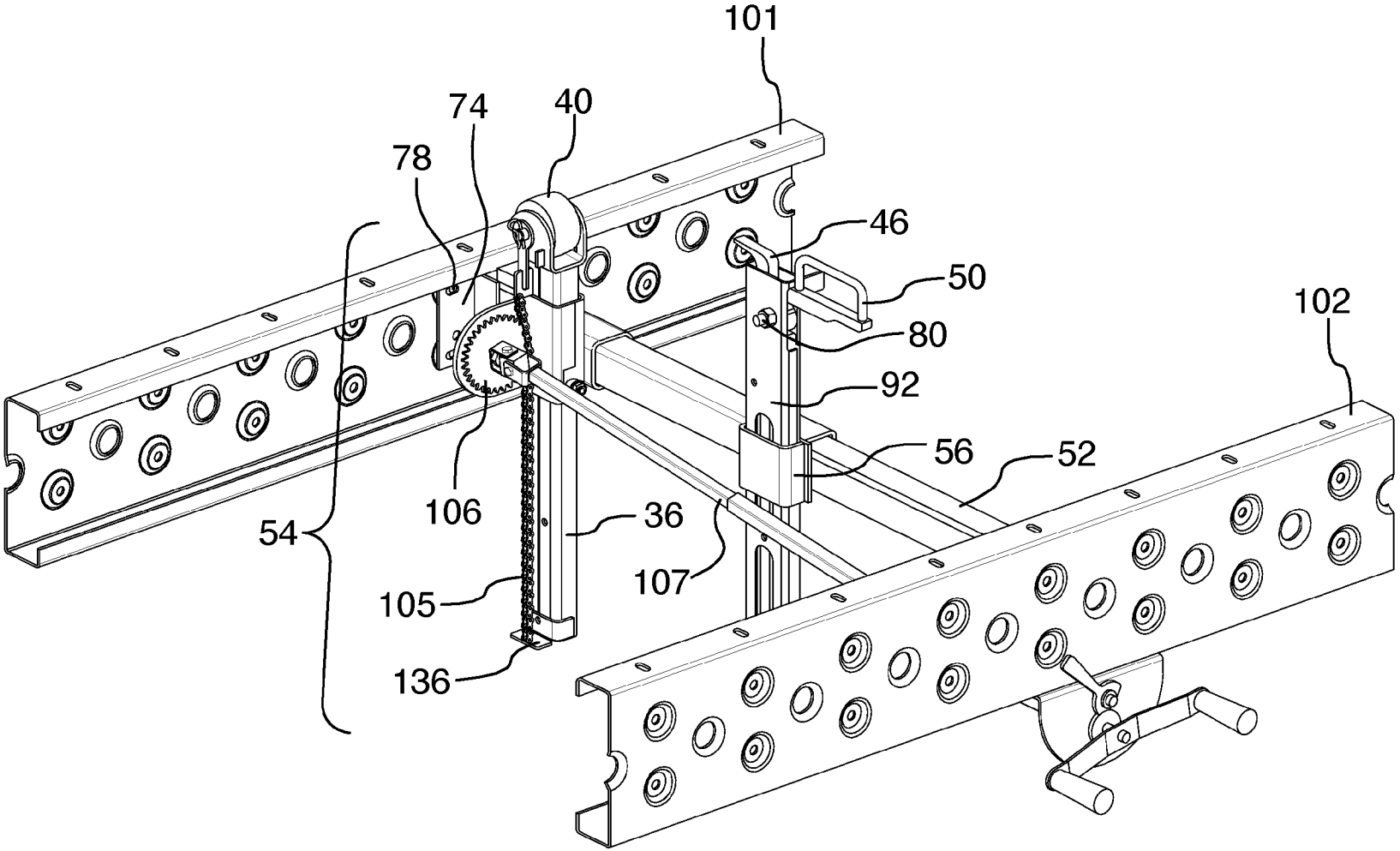
FIG. 1 shows a front perspective view of the log support/clamping system of the present application.
Figure 2:
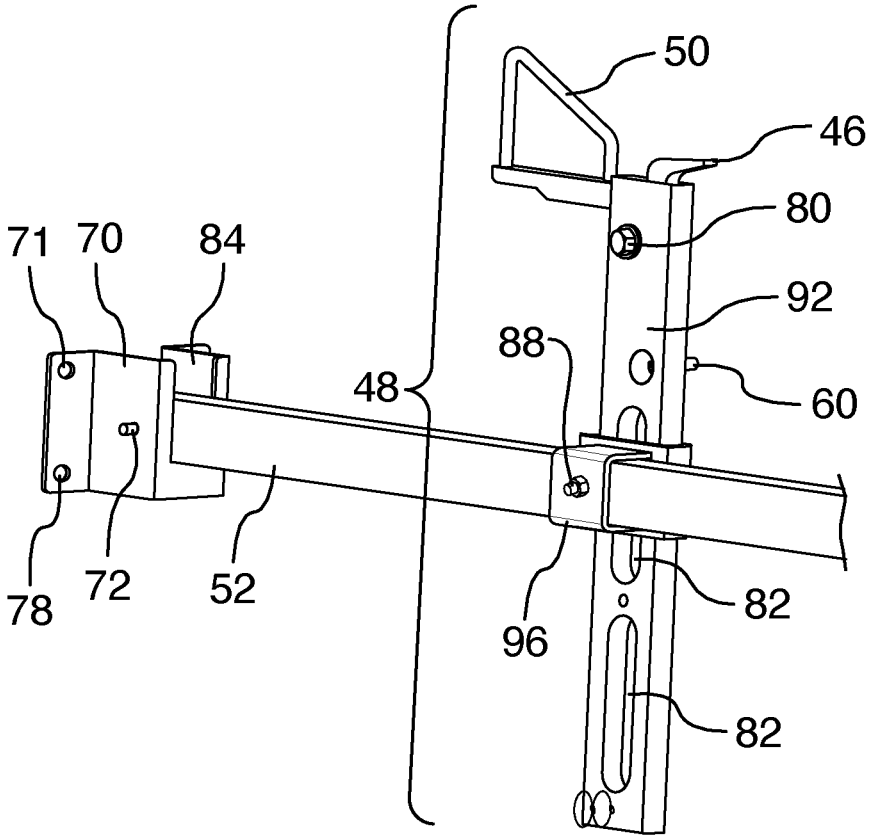
FIG. 2 shows a rear perspective view of the log dog of FIG. 1.

As shown in FIG. 1, the log support system comprises a support beam 52 designed to be affixed to a sawmill (not shown) between sawmill bed rails 101, 102 using sawmill brackets 70, 74. The sawmill brackets 70, 74 may also be part of sawmill rails 101, 102. Attached to support beam 52 are log dog 48 and log rest 54. The design is such that the sawmill brackets 70, 74 can be affixed to opposing sides of the sawmill rails 101, 102 by screwing them thereto utilizing screw holes 78. As shown in FIGS. 1 and 2, log dog 48 and log rest 54 may then be easily affixed to or removed from the sawmill rails 101, 102 through removal of sawmill bracket pin 72 shown, lateral displacement of the support beam 52 through sawmill support opening 84 in bracket 70, then displacement of the log dog 48 and log rest 54 beyond the end of support beam 52.

As seen in FIGS. 1 and 2, log dog 48 is removably affixed to the support beam 52, through housing front 56 and back 86 which together receive vertical portion 92. Vertical portion 92 comprises pick 46 and log support 50 (may also be referred to as log dog handle) at its top end, pin limiters 60 at its bottom end, and adjustment apertures 82 extending vertically therebetween. Apertures 82 lighten the weight of the log dog 48. Housing 56 allows vertical displacement of vertical portion 92 in relation to housing 56, 86 and therefore support beam 52. As seen in FIG. 2, housing 86 allows horizontal displacement of log dog 48 in relation to support beam 52, when housing screw 88 is loosened. Vertical portion 92 can thus be displaced vertically within adjustment apertures 82, and can be displaced horizontally, along with housing 56, 86, along support beam 52. When housing screw 88 is tightened, housing 86 forms a clamp which affixes the log dog 48 in a horizontal position relative to support beam 52, limiting horizontal displacement relative to support beam 52. A second housing screw (not shown) secures log dog 48 in a desired vertical position relative to support beam 52. Alternatively pin limiters (e.g. 60) can secure log dog 48 in a desired vertical position.

Log dog 48 can be removed from support beam 52, by removing pin limiters (62, 64) located at the bottom of the log dog 48, and lifting vertical portion 92 out of housing 56, 86. Log dog 48, along with housing 56, 86, can also be removed from support beam 52 by removing support beam 52 from sawmill bracket 70 as described above and displacing vertical portion 92 horizontally beyond the end of support beam 52.

Typically, log dog 48 is adjusted horizontally and vertically in relation to support beam 52 each time a log is clamped. The horizontal and vertical positioning will depend on the size of the logs to be cut. For example, for larger logs, log dog 48 will typically have a horizontal location on support beam 52 that is closer to sawmill bracket 70, as compared to its positioning for smaller logs. With large logs, both log dog and log rest will each be as far apart from each other and, as close to their respective sawmill rails 101, 102. Vertical displacement will be such that pick 46 will be further away from support beam 52 for larger logs as compared to smaller logs. Once log dog 48 is adjusted for use, finer adjustments for each particular log, and clamping the log can be performed using log rest 54. Typically, the user adjusts the log rest, then the log dog. Either or both may require finer adjustment. The log dog 48 freely slides vertically and horizontally. Each time a log is clamped, adjustments are made on both planes. The adjustment made to the log rest 54 is independent of those made with the log dog. As explained in more detail below, an operator first adjusts the log rest 54 and then adjusts the log dog 48 and clamp. The primary similarity in the adjustments made to both the log dog and log rest is that their vertical displacement is dependant on log size.

Figure 3:
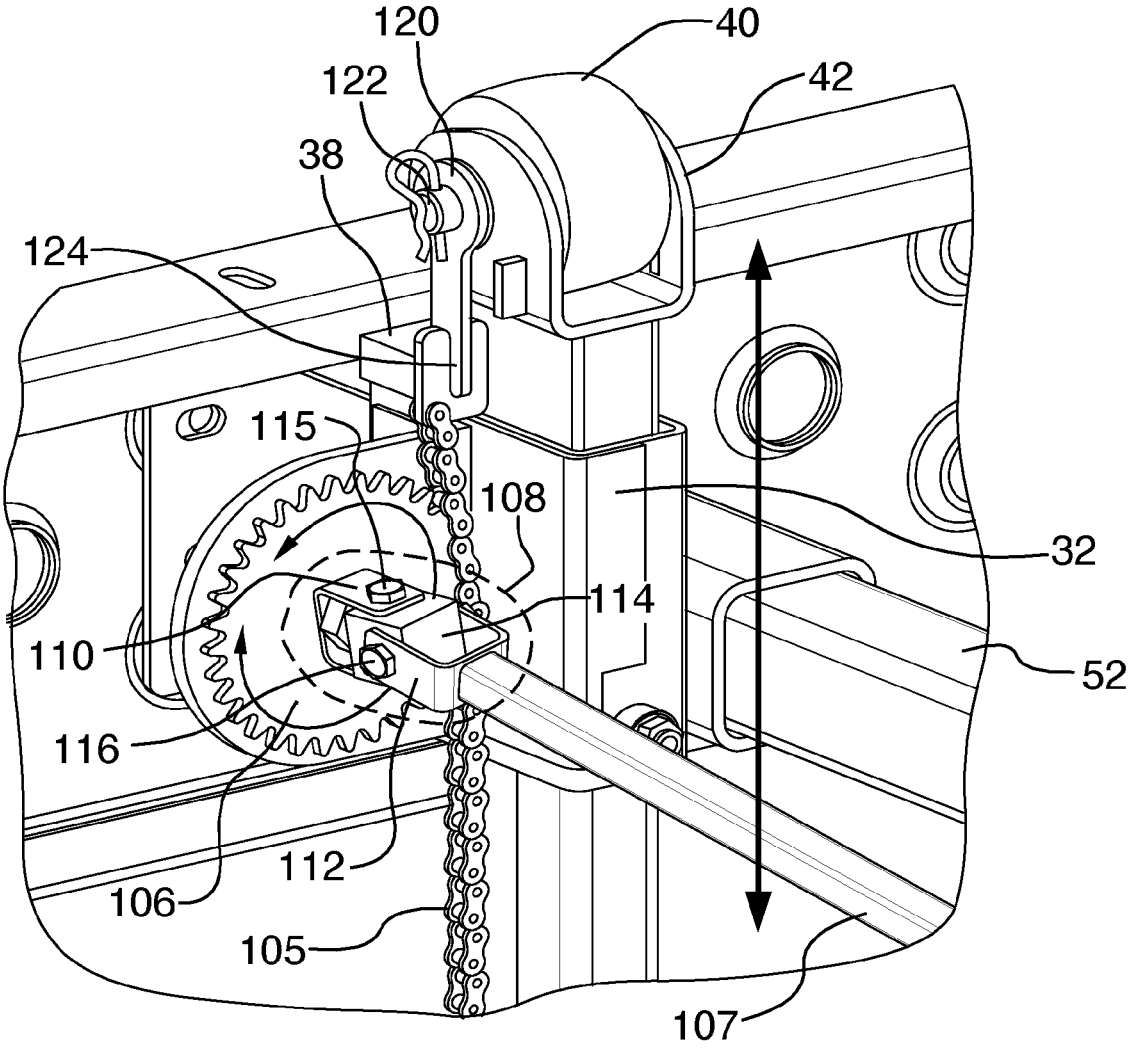
FIG. 3 shows a sectional front perspective view of the log rest having a rack and pinion mechanism of FIG. 1.

As seen in FIG. 3, log rest 54 comprises log rest housing 32 which is affixed to support beam 52. Log rest housing 32 comprises clamp housing lock (not shown) which enables the log rest housing 32 (and thus log rest 54) to be affixed to the support beam 52. Loosening a clamp housing lock (not shown) allows the log rest housing 32 (and thus the entire log rest 54) to be horizontally displaced along support beam 52.

As seen in FIGS. 1 and 3, log rest housing 32 houses post 36 which can be vertically displaced relative to log rest housing 32 utilizing ratcheting means.

Note that clamp housing lock does not affect vertical displacement of post 36. Post 36 comprises wheel 40 at its top end, which has a rigid cuff 42. Attached to the rigid cuff 42 is connection 120 and pin 122, to secure the wheel 40 to the rigid cuff 42. As well, the connection 120 extends in one direction to an end 124. The end 124 of the connection 120 is attached to a securing connection 130. The bottom of the post 36 also has a securing plate 136 which extends out from the post 36. A chain 105 is attached or integrally formed at a top end to the securing connection 130, and the bottom end of the chain 105 is attached to the securing plate 136 of the post 36. The chain 105 is tensioned on both the top end and the bottom end to act as a rack. Alternatives to the chain 105 can be used, such as a stamped or cut metal rack with teeth.

As seen in FIG. 3, the chain 105 works with a pinion or ratcheted wheel 106. More particularly, the teeth of the ratcheted wheel 106 mesh or engage with teeth on the chain 105. Log rest housing 32 has support plate 115, and the ratcheted wheel 106 is mounted to the support plate 115. The ratcheted wheel 106 is connected to a shaft 107 via a universal joint 108. The shaft 107 may be extendable to vary its length depending on the width between sawmill rails 101, 102. The universal joint 108 includes a pair of hinges 110, 112 located close together and oriented at ninety degrees to each other. As well, the universal joint 108 includes a central cube component 114 that connects the pair of hinges 110, 112. In another embodiment, the pair of hinges 110, 112 may be connected using a cross shaft (not shown). Bolts 116, 117 secure the hinges 110,112 to the central cube component 114. The universal joint 108 permits the shaft 107 to rotate and hinge as required during actuation of the ratcheted wheel 106 traversing the chain 105.

Figure 4:
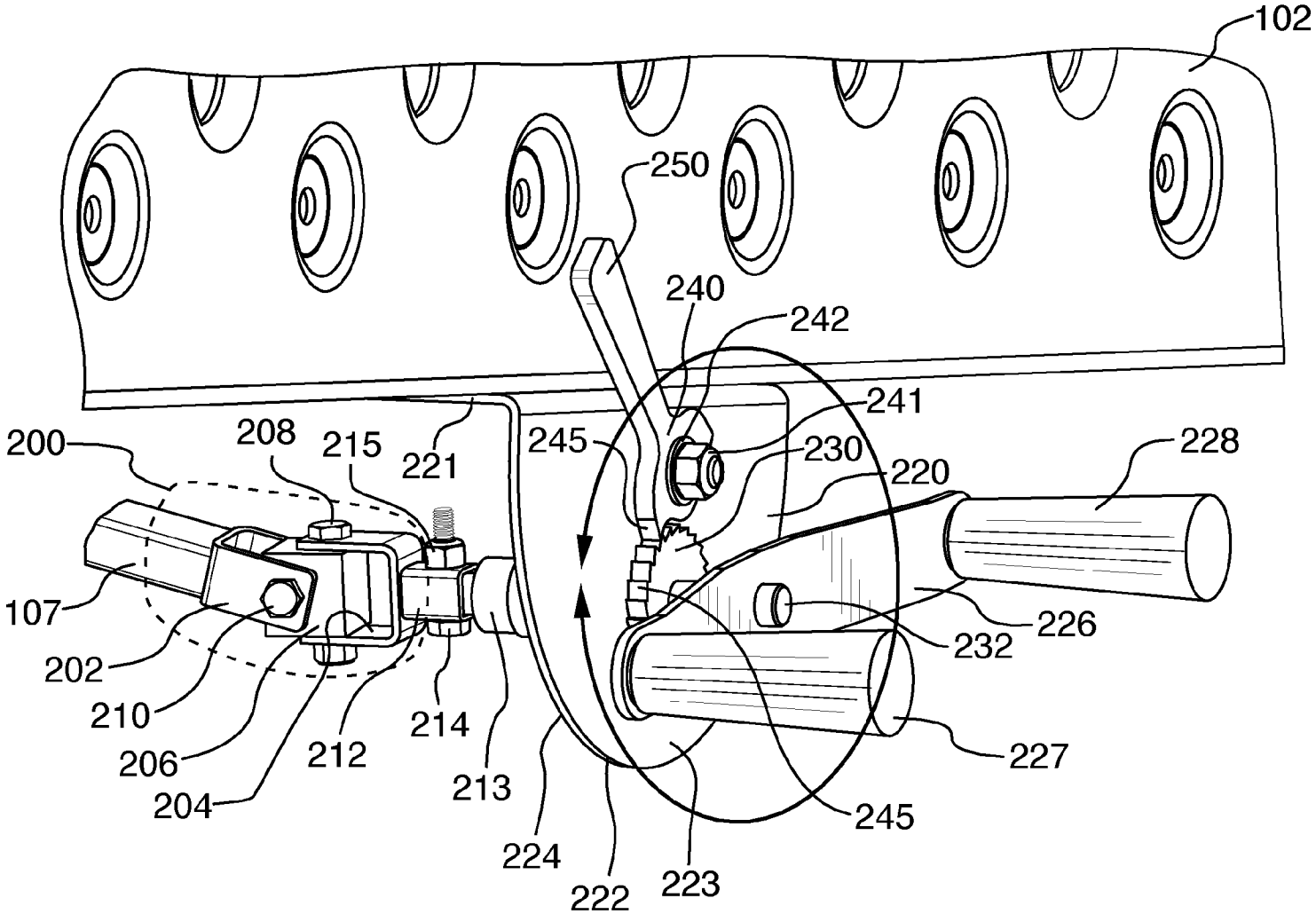
FIG. 4 shows a sectional side perspective view of the actuation mechanism for the log rest of FIG. 1.

As seen in FIG. 4, the shaft 107 is connected at a second end to a second ratcheted wheel 230 (on the opposite side of the sawmill, i.e. the side of rail 102) via a second universal joint 200 located at the operator's side of the sawmill. The second universal joint 200 includes a pair of hinges 202, 204 connected by a central cube component 206. The pair of hinges 202,204 are secured to the central cube component 206 via a pair of bolts 208, 210.

The second ratcheted wheel 230 is mounted to an L-shaped bracket connection 220. A first side 221 of the bracket connection 220 is attached to the bottom of rail 102, with a second side 222 of the bracket connection 220 extending down from the exterior edge of rail 102. The second ratcheted wheel 230 is mounted to the exterior face 223 of the second side 222 which is on the operator's side of the sawmill. Also on the operator's side, there is a handle plate 226 that is connected to the second ratcheted wheel 230 via a cylindrical shaft 232. One or more handles 227,228 are attached to the handle plate 226. The cylindrical shaft 232 passes through an opening on the bracket connection 220 and attaches to a bushing 213 on the interior side 224 of the second side 222 of the bracket connection 220. A connection component 212 secures the bushing 213 to the second universal joint 200 using a bolt 214 and nut 215.

A pawl 240 is secured to the exterior face 223 of the second side 222 of the bracket connection 220 using a bolt 241 and washer 242. The pawl 240 has a ratchet tooth 245 that is adapted to fit into a notch of the second ratcheted wheel 230. As well, the pawl 240 has pawl handle 250 that may be used to move the pawl 240 from a first position to lock the second ratcheted wheel 230 in place, to a second position which removes the ratchet tooth 245 from a notch of the second ratcheted wheel 230. The pawl 240 may be used to lock the second ratcheted wheel 230 in place, and thereby locking the vertical position of the log rest housing 32 along post 36 by arresting the rotational movement of 107. In a preferred embodiment, the pawl and notches are configured to allow free movement of the rack and pinion in an upwards, counterclockwise motion, when the pawl is unlocked.

Handles 227,228 and pawl 240 thus allow the operator to move the post 36 up or down by releasing the pawl 240 and by rotating the handles 227, 228. The post 36 may be locked in the selected position by returning the pawl 240 to its engaged position. In operation, the handles 227,228 are rotated to turn the second ratcheted wheel 230 and the cylindrical shaft 232, which rotates the shaft 107 and thereby actuates the ratcheted wheel 106 to move the ratcheted wheel 106 up or down the chain 105, resulting in movement of the post 36 up or down relative to the log rest housing 32. The handles 227,228 may be rotated in a clockwise direction to actuate the ratcheted wheel 106 up the chain 105 to lower the vertical position of the post 36. As well, the handles 227,228 may be rotated in a counterclockwise direction to actuate the ratcheted wheel 106 down the chain 105 to raise the vertical position of the post 36.

Post 36 may comprise horizontal adjustment bolt (not shown), which allows for fine tuning of the horizontal location of post 36 relative to support beam 52, even while log rest housing 32 is secured and horizontally affixed to support beam 52. As previously discussed, the lower end of post 36 also comprises the securing plate 136 which prevents the post 36 from so much vertical displacement that it is inadvertently removed out of the top of log rest housing 32.

The log rest is used as follows. The horizontal and vertical location of log dog 48 relative to support beam 52, and the horizontal position of log rest 54 relative to support beam 52 are set to a desired position, based on the size of the logs to be milled. The position is estimated by the user such that the diameter of the log is slightly larger than the distance between the log dog 48 and the log rest 54. The post 36 is set at its lowest position by releasing the pawl 240 using pawl handle 250 and rotating the handles 227,228 to actuate the ratcheted wheel 106 to traverse up the chain 105. The log is placed, pushed, or rolled against the log rest. Log dog handle 50 is configured such that a downward force on it causes a cam or apertures 82 inside to be forced against the pick 46 which, in turn, is pressed into the log. The log is rolled onto the log deck, and rests on the cross bunks (spans between the rails). It is positioned into the area between the log rest 54 and the log dog 48. The user then displaces the post 36 upwards, using the rack and pinion mechanism actuated by handles 227,228 such that the log rest 54 supports the log but is lower than the path along which the blade will travel. Once post 36 is adjusted for correct height, the operator pushes the log against post 36, vertically and horizontally adjusts vertical portion 92, lifts handle 50, pushes log dog 48 against the log, lowers handle 50, thereby forcing pick 46 into the log. This allows for clamping of the log between the log dog 48 and the log rest 54. As the clamping gets tighter, pick 46 digs into the side of the log, providing more stability. In this manner, utilizing handles 227,228, a user is able to clamp the log between the post 36 and the pick 46 utilizing one hand and while remaining on the operator's side of the sawmill. Log rest housing 32 also comprises square block surface 38, which provides support for post 36 as post 36 presses against the log.

It is to be understood that the present invention is not limited to the embodiments described above, but encompasses any and all embodiments within the scope of the following claims.

TABLE OF ELEMENTS

32 Log rest housing
36 Post
38 Square block surface
40 wheel
42 rigid cuff
46 pick
48 log dog
50 log dog handle or log support
52 support beam
54 log rest
56 housing front
60 pin limiter
70 sawmill bracket
72 sawmill bracket pin
74 sawmill bracket
78 screw holes
82 apertures
84 sawmill support opening
86 housing back
88 housing screw
92 vertical portion of log dog
101 sawmill rail
102 sawmill rail
105 chain
106 pinion or ratcheted wheel
107 shaft
108 universal joint
110 hinge
112 hinge
115 support plate
116, 117 Bolts
120 connection
122 pin
124 end of connection component
130 securing connection
136 securing plate
200 second universal joint
202 hinge
204 hinge
206 central cube component
208 bolt
210 bolt
213 bushing
214 bolt
215 nut
220 L-shaped bracket connection
221 first side of bracket connection
222 second side of bracket connection
223 exterior face of second side
224 interior face of second side
226 handle plate
227 handle
228 handle
230 second ratcheted wheel
232 cylindrical shaft
240 pawl
241 bolt
242 washer
245 ratchet tooth
250 pawl handle

What is claimed is:

1. A log rest assembly comprising:
a vertically extending log rest post;
a post housing assembled with the post, said post being vertically displaceable therewith; and
a rack secured to the post and a pinion secured to the post housing, the rack and pinion being operable to raise and lower the post by vertically sliding the post in relation to the post housing;
wherein the rack and pinion comprises a tensioned chain attached to the log rest assembly; and a ratcheted wheel attached to the post housing for engaging teeth on the tensioned chain.

2. The log rest assembly of claim 1 further comprising an actuation mechanism comprising:
a second ratcheted wheel;
a rotatable shaft extending from the ratcheted wheel to the second ratcheted wheel; and
a handle attached to the second ratcheted wheel for actuating the ratcheted wheel,
wherein rotation of the handle causes the ratcheted wheel to traverse the chain, thereby raising or lowering the vertical position of the post.

3. The log rest assembly of claim 2 further comprising a pawl having a tooth for engagement with a notch of the second ratcheted wheel, wherein the pawl locks the vertical position of the post.

4. A log rest assembly comprising:
a vertically extending log rest post;
a post housing assembled with the post, said post being vertically displaceable therewith; and a rack secured to the post and a pinion secured to the post housing, the rack and pinion being operable to raise and lower the post by vertically sliding the post in relation to the post housing;

wherein the post has a wheel at a top end.

5. The log rest assembly of claim 3 wherein in an unlocked position, the post is vertically displaceable, and in a locked position, the post is vertically non-displaceable.

6. The log rest assembly of claim 3 wherein the pawl and the notch are configured to allow free movement of the rack and pinion when the pawl is unlocked.

7. The log rest assembly of claim 1, wherein the rack and pinion are manually operable to raise and lower the post.

8. The log rest assembly of claim 1 affixed to a bed of a portable sawmill.

9. The log rest assembly of claim 1, further comprising a handle for manually operating the rack and pinion.

10. A log rest assembly comprising:

a post;

a post housing, said post being vertically displaceable therein; and a rack and pinion for raising and lowering the post, wherein the rack and pinion comprises:

a tensioned chain attached to the log rest assembly; and a first ratcheted wheel attached to the post housing for engaging teeth on the tensioned chain; and an actuation mechanism comprising:

a second ratcheted wheel;

a rotatable shaft extending from the first ratcheted wheel to the second ratcheted wheel; and a handle attached to the second ratcheted wheel for actuating the first ratcheted wheel, wherein rotation of the handle causes the first ratcheted wheel to traverse the chain, thereby raising or lowering the vertical position of the post.

11. The log rest assembly of claim 10 further comprising a pawl having a tooth for engagement with a notch of the second ratcheted wheel, wherein the pawl locks the vertical position of the post.

12. The log rest assembly of claim 11, wherein in an unlocked position, the post is vertically displaceable, and in a locked position, the post is vertically non-displaceable.

* * * * *